US009321181B2

(12) United States Patent
Peppett

(10) Patent No.: US 9,321,181 B2
(45) **Date of Patent: *Apr. 26, 2016**

(54) TWO WHEELED, HAND DRIVEN, LAMINA MATERIAL, SHAPE CUTTER

(71) Applicant: Robert Anthony Peppett, Svitavy (CZ)

(72) Inventor: Robert Anthony Peppett, Svitavy (CZ)

( * ) Notice: Subject to any disclaimer, the term of this patent is extended or adjusted under 35 U.S.C. 154(b) by 0 days.

This patent is subject to a terminal disclaimer.

(21) Appl. No.: 14/852,709

(22) Filed: Sep. 14, 2015

(65) Prior Publication Data

US 2016/0008991 A1 Jan. 14, 2016

Related U.S. Application Data

(63) Continuation-in-part of application No. 14/275,228, filed on May 12, 2014.

(51) Int. Cl.

| | |
|---|---|
| ***B26B 5/00*** | (2006.01) |
| ***B26B 29/06*** | (2006.01) |
| ***B26B 3/08*** | (2006.01) |
| ***B26B 29/02*** | (2006.01) |

(52) U.S. Cl.

CPC . *B26B 5/005* (2013.01); *B26B 3/08* (2013.01); *B26B 29/02* (2013.01); *B26B 29/06* (2013.01)

(58) Field of Classification Search

CPC ..... A41H 31/005; B27G 17/04; B26B 3/00–3/08; B26B 5/00; B26B 5/005; B26B 5/006; B26B 27/00; B26B 29/02; B26B 29/06

See application file for complete search history.

(56) References Cited

U.S. PATENT DOCUMENTS 2,439,639 A * 4/1948 Tilly ..... B43M 7/002 30/289
2,535,555 A * 12/1950 Tilly ..... B43M 7/002 30/125
3,137,192 A 6/1964 Mcneill
3,286,351 A * 11/1966 McAlister ..... B25H 7/04 30/263
3,365,798 A * 1/1968 Cunningham ..... A61F 15/02 30/287
3,380,159 A * 4/1968 Winston ..... B26B 27/005 30/125
3,513,744 A 5/1970 Hershberger
3,613,241 A * 10/1971 Allen ..... B26B 27/00 30/294
3,859,725 A 1/1975 Anderson
3,921,287 A * 11/1975 Gomez ..... A47J 17/00 30/123.5
3,934,342 A * 1/1976 Matsushita ..... B26B 5/005 30/293
4,062,116 A 12/1977 Arnott
4,068,375 A * 1/1978 Rathbun ..... B26B 5/001 30/125

(Continued)

FOREIGN PATENT DOCUMENTS

| | | | |
|---|---|---|---|
| DE | 20212218 U1 | * | 12/2002 |
| GB | 2277705 A | | 11/1994 |
| GB | 2496669 B | * | 10/2013 |

*Primary Examiner* — Stephen Choi

(57) ABSTRACT

A cutting device comprises a body having two opposing sides which are mirror images and are fastened together by a plurality of fasteners, the body comprises a forward facing substantially triangular portion and a rearward facing substantially rectangular portion, a wedge member, the wedge member comprises a top side, a bottom side, a first end, a second end thicker than the first end, the top side of the wedge extending along a bottom surface of the substantially triangular portion to define a space there between, an interior cavity defined by the opposing sides of the body, a cutting blade being received in the cavity wherein a portion of the cutting edge extends outward from the bottom surface of the substantially triangular portion and into the space so that the portion of the cutting edge is exposed and two wheels mounted on each side of the of the body.

6 Claims, 10 Drawing Sheets

(56) References Cited

U.S. PATENT DOCUMENTS 4,109,380 A * 8/1978 Anderson ..... B26B 5/00 30/125
4,385,440 A * 5/1983 Webb ..... B26B 27/00 30/294
4,884,342 A * 12/1989 McNamara ..... B26B 29/02 30/162
5,174,028 A * 12/1992 Seltzer, Jr. ..... B26B 5/005 30/329
5,347,719 A * 9/1994 Scharf ..... B26B 5/005 30/294
5,419,044 A * 5/1995 Valliere ..... B67B 7/30 30/2
5,438,757 A 8/1995 Weschenfelder
5,638,603 A * 6/1997 Li ..... B26B 27/00 30/280
D418,036 S * 12/1999 Shearer ..... D8/98
6,112,417 A 9/2000 Hyer
6,226,824 B1 5/2001 Hopson
6,684,512 B1 2/2004 Bareis
6,748,659 B1 * 6/2004 Street ..... B26B 5/005 30/162
6,857,192 B1 * 2/2005 Summers ..... B26B 5/001 30/162
6,952,878 B1 10/2005 Bareis
7,051,443 B2 * 5/2006 Mueller ..... B26B 29/02 30/125
7,526,865 B2 * 5/2009 Mueller ..... B26B 5/00 30/123
D649,854 S * 12/2011 Packard ..... D8/98
8,220,162 B2 7/2012 Rayner
8,495,818 B1 * 7/2013 Peppett ..... B26B 29/00 30/280
2002/0062566 A1 * 5/2002 Janser ..... B26B 3/08 30/290
2008/0250654 A1 10/2008 Chang
2013/0160303 A1 * 6/2013 Everett ..... B26B 29/06 30/287
2013/0312271 A1 * 11/2013 Floyd ..... E04F 21/0084 30/294

* cited by examiner

TWO WHEELED, HAND DRIVEN, LAMINA MATERIAL, SHAPE CUTTER

This application is a continuation-in-part of U.S. patent application Ser. No. 14/275,228 filed on May 12, 2014, which application is incorporated in its entirety herein by reference.

FIELD OF THE INVENTION

The present invention relates to a lamina cutting device. More particularly, the present invention relates to a portable, manual shape cutting device for cutting a wide variety of lamina material into shapes.

BACKGROUND OF THE INVENTION

Numerous manual, hand driven tools for cutting similar material have been provided in prior art. For example U.S. Pat. No. 3,137,192, U.S. Pat. No. 3,513,744, U.S. Pat. No. 3,859,725, U.S. Pat. No. 4,062,116, U.S. Pat. No. 5,438,757, U.S. Pat. No. 6,112,417, U.S. Pat. No. 6,226,824, U.S. Pat. No. 6,684,512, U.S. Pat. No. 6,952,878, U.S. Pat. No. 8,220,162, US Pat No 20080250654, GB Pat No 2277705A. While these units may be suitable for the particular purpose to which they address, they would not be suitable for the purposes of the present invention as heretofore described.

U.S. Pat. No. 3,137,192 issued to Mcneill Robert M on Jun. 16, 1964 titled Material cutting device discloses a device designed to cut paper and the like and, more particularly, to a cutting head and rail which accurately and reproducibly cut materials of a wide variety of thickness and finish. In case of this device, the material being cut is held firmly in position to produce accurate and reproducible cuts without the necessity for manually holding or adjusting the material to compensate for the shifting of position of the material caused by the build-up of unbalancing forces during the cutting operation.

U.S. Pat. No. 3,513,744 issued to Hershberger Paul R on May 26, 1970 titled Map or chart cutter discloses a device for cutting out a portion of a large map or navigation chart, the portion so cut out being of interest to personnel of a vehicle travelling between two locations represented by points on the map. A carriage mounted on rollers supports a pair of spaced-apart cutting edges which, as the carriage is manually moved along a guide overlying the two points of interest on the map, cuts out from the latter a strip which can be conveniently handled by personnel of the vehicle without being encumbered with the remaining map portion which contains nothing of interest insofar as this particular journey of the vehicle is concerned.

U.S. Pat. No. 3,859,725 issued to Alexander Gilbert L on Jan. 14, 1975 titled Carpet cutting tool discloses a manually operated carpet cutting tool wherein a pair of spaced carpet receiving jaw members have transversely extending there between a cutting blade having its cutting edge sloping rearwardly and being held at its rearward edge in a slot provided in a pile comb. A cut pressure and cutting start member parallels each side of the jaws and is mounted at one end thereof for pivotal motion to initiate cutting.

U.S. Pat. No. 4,062,116 issued to Arnott Gertrude V on Dec. 13, 1977 titled Fabric cutting tool discloses a fabric cutting tool comprising an elongated shank curved and bifurcated at one end and a handle on the other, the bifurcated end having a spring loaded rotary cutting blade rollingly mounted between the bifurcation, a protective shield for the blade, a pair of guide wheels for assisting in the cutting, and a foot plate providing a cutting surface for the fabric U.S. Pat. No. 5,438,757 issued to Weschenfelder; Sonja on Aug. 8, 1995 titled Multifunction cutting tool discloses a multifunction cutting tool which includes a cutting head adjustable for straight, free form or circular cutting of glass and tile, interchangeably mountable hobby and hook blades for cutting carpet, PVC, matting and the like, a roller cutter for cutting cloth, wallpaper, leather and similar sheet material, knife and scissor sharpeners and an angled carpet cutter blade mounted in a carriage with a base plate for sliding under the carpet. The tool has blade guards to protect the user from accidental injury and brackets supporting the cutting blades that are stabilized by resilient snap fittings and laterally extending support shoulders. Access to retractable folding hobby and hook blades is improved by the addition of screw-driver tip receiving pivot slots in the blades and the work surface of circular cuts is protected by a suction cup having a recessed and covered metal attachment.

U.S. Pat. No. 6,112,417 issued to Hyer; Michael L. on Sep. 5, 2000 titled Precision vinyl & carpet trimmer discloses a hand operated trimmer for trimming an edge of vinyl, carpet or the like being installed on a floor so that the cut edge of the floor covering will lie closely against an adjacent wall. The trimmer comprises an elongate base member and an integral cutting blade. The base member has a generally triangularly shaped cross section, with two of the elongate external surfaces of the base member meeting at a right angle, and the elongate external surface opposite the right angle being a concave surface. The cutting blade is mounted closely adjacent the concave surface and in a substantially perpendicular relationship thereto. Pressure applying rollers are spaced a slight distance from the concave surface so as to define a vinyl-receiving entry location for a vinyl sheet to pass in a longitudinal direction along the concave surface, with the pressure applying rollers serving to keep the vinyl sheet in close contact with the concave surface. The cutting blade is mounted in alignment with the path of travel of the vinyl along the concave surface, whereby upon an installer causing a vinyl sheet to enter the entry location, the external surfaces of the base member meeting at a right angle can be moved longitudinally along the floor-wall intersection. At that time the blade cuts the vinyl at a location coinciding with the intersection of the floor with the adjacent wall, such that the cut edge of the vinyl will reside closely and evenly along the wall.

U.S. Pat. No. 6,226,824 issued to Eric J. Hopson on May 8, 2001 titled Knife with multiple roller wheels discloses a knife with multiple roller wheels comprising an elongate hollow housing adapted to be held and operated by one hand. The housing has a first end with a slot and an opposite second end. A knife blade is provided. A structure is for retractably extending the knife blade from the slot in the first end of the housing to trim a window screen. Two roller wheels are also provided. A facility is for rotatably supporting in spaced apart relationships the two roller wheels. An assembly pivotally connects the supporting facility to one side of the housing adjacent to the second end. A stop member supports the supporting facility in a stationary position, so that one of the roller wheels will extend beyond the second end of the housing to install the window screen in a window screen frame.

U.S. Pat. No. 6,684,512 issued to Kathryn M. Bareis on Feb. 3, 2004 titled Rolling sheet material cutting device discloses a rolling device for cutting sheet material including a planar body member supported vertically on wheeled axles oriented perpendicularly to the vertical planar body member. The planar body member includes a cutting notch and a contained cutting blade member with a cutting edge exposed within the cutting notch. A handle member is secured to the planar body member and extends upwardly opposite the wheeled axles. A crossbar can be attached to the handle member. A user grasps the handle member, or crossbar, and rolls the planar body member forward on the wheeled axles to cut a sheet of material passing into the cutting notch U.S. Pat. No. 6,952,878 issued to Bareis Kathryn on Oct. 11, 2005 titled Mobile sheet material cutting device discloses a self-standing mobile device for cutting sheet material including a body member connected to at least one wheeled axle to translationally move the body member about a surface on which the device self-stands. The body member includes a cutting notch with open and closed ends, the cutting notch positioned with the open end above the at least one wheeled axle. The body member including a contained cutting blade member with cutting edge exposed within the cutting notch closed end, the cutting blade member oriented substantially perpendicularly to the surface on which the device self-stands. A user may engage the device to move the device about the surface on the at least one wheeled axle to cut a sheet of material passing into the cutting notch. Handle and shoulder features, and related methods of cutting sheet material are also disclosed.

U.S. Pat. No. 8,220,162 issued to Rayner Design Pty Ltd on Jul. 17, 2012 titled Cutter device discloses a manually operable cutter device for cutting flexible sheet material, the cutter device comprising a cutter body and a cutting blade assembly operatively mounted to the cutter body and including a rotatable cutter blade having a peripheral edge portion and a fixed cutter blade adapted to cooperate together to provide a cutting zone in which sheet material can be cut. The rotatable cutting blade is mounted for rotation about an axis which extends generally laterally with respect to a normal feed direction of the sheet material to the cutting zone and the direction of rotation of the peripheral edge portion through the cutting zone is in the normal feed direction.

US20080250654 issued to Pi-Chao Chang on Oct. 16, 2008 titled Dual-use knife discloses a device having a circular blade and a guide rod combined together. A dual-use knife having a circular blade and a guide rod combined together. When the rotatable circular blade is attached to a cloth-cutting guide rode a positioning cutting state of the stationary circular blade can be obtained so that the application range of the circular blade can be enlarged. In addition, the circular blade or the combination of the cloth-cutting guide rod and the circular blade can be positioned and operated on two sides of the knife so that the knife may be properly held by left and right hands. In addition, when the circular blade is combined with the guide rod, a circular blade upper cover can be rotated so that the position of the cutting point of the circular blade may be arbitrarily changed from 0 to 360 degrees, and a multi-function knife may be formed.

GB2277705A titled Kitchen packaging cutter discloses a kitchen packaging cutter has a replaceable blade 2 clamped by a plate 3 to a body 1. A guide slot 6 is formed through the body length. A free turning roller 4 protrudes slightly over the guide slot 6 with a cutting edge of the blade 2 just clearing roller 4. The guide slot allows plastic food packs and cartons with varying flange measurements to pass between the cutting blade and roller to facilitate the cutting of the package and subsequent release of its contents. A second protruding cutting edge of blade 2 is sighted to the left of the body in right angle 7 and enables the opening of cardboard boxes, whether wrapped in plastic or cellophane, with little effort. A push-pull blade guard 9 may be fitted to the body to guard the second cutting edge.

OBJECTS OF THE INVENTION

The cutting device according to the present invention is especially designed to cut lamina materials into shapes, at the same time due to its design it is safe, efficient, conveniently mobile and very easy to use.

One object of the present invention is to provide a hand held manually driven cutting device especially designed for shape cutting of lamina materials that in most situations is able to cut as quickly and accurately as scissors, craft knives, battery and manual powered rotating knife's. At the same time, due to its design, the cutting device of the present invention is cheaply available to the end user. Furthermore, unlike alternative cutting knives, it performs a cutting operation whilst eliminating the risk of injury to the operator.

Another object is to provide a hand held manually driven cutting device that is able to cut at an acute radius or angle a lamina material without compromising operating time constraints and accuracy.

Still another object is to provide an ambidextrous shape cutting device that can be operated using a single hand with equal facility by either hand.

A further object is to provide a shape cutting device for which it is possible to use commonly available cutting blades such as the blades found in low cost craft knives.

A still further object is to provide a shape cutting device having an ergonomic design.

A still further object is to provide a shape cutting device having a graspable body that is dividable into two parts along its vertical axis.

Yet another object is to provide a shape cutting device with a wedge shaped material lifting and supporting element that extends from the underside of the graspable body wherein the lifting and supporting element is clamped into position when both parts of the graspable body are joined together by means of screws.

A still further object is to provide a shape cutting device that, during operation and storage, prevents any possibility of accidental human contact with the knife blade. A still further object is to provide a shape cutting device that during operation, the lifting and supporting element combined with the outer walls of the front substantially triangular portion of the substantially pistol shaped graspable body assembly are arranged to prevent any possibility of accidental human contact with the knife blade.

Yet another object is to provide a shape cutting device that prevents the point of the knife blade from causing any undercut scoring or damage upon the working surface.

A still further object is to provide a shape cutting device wherein the possibility of nicking or movement of the material during the cutting process is considerably diminished.

A still further object is to provide a shape cutting device that utilizes a cutting blade positioned at the center in between a pair of wheels with the cutting edge of the blade lying in line with the axle of the pair of wheels.

SUMMARY OF THE INVENTION

The following presents a simplified summary in order to provide a basic understanding of some aspects of the disclosed invention. This summary is not an extensive overview, and it is not intended to identify key/critical elements or to delineate the scope thereof. Its sole purpose is to present some concepts in a simplified form as a prelude to the more detailed description that is presented later.

Accordingly, there is provided a hand driven shape cutting device wherein the graspable body is of substantially pistol shape having a front substantially triangular portion and a rear substantially rectangular portion protruding rearward forming a graspable handle so that, when the device is clasped by the hand of a user to impart a forwardly actuating force, the front substantially triangular portion defines an inclined force entry direction whereby, in association with the actuating rolling motion, clamping down force is applied through the wheels onto the material to be cut.

The hand held cutting device comprises a two part dividable opposing sides, each opposing sides having a mirror image outer surface and periphery that, when coupled with its partner, results in an assembly forming an ambidextrous graspable handle; a knife blade clamped firmly between the two substantially pistol shaped body parts with its cutting edge protruding forwardly beneath the front substantially triangular portion of the substantially pistol shaped body assembly; a pair of wheels, each wheel attached to an axle, situated to lower rear distal point on either outer side of the front substantially triangular portion of the substantially pistol shaped body assembly; a lifting and supporting element also referred to as a wedge member extending from the underside of the front substantially triangular portion wherein an engagement space for material to be lifted is apportioned between the distal front edge of the lifting and supporting element and the forward distal point of the front substantially triangular portion facing the direction of travel, the lifting and supporting element is arranged to lift the material to be cut and also form a protecting periphery such that any part of cutting edge of the knife does not protrude outside the periphery; the knife blade and supporting element are supported and clamped in position by the two substantially pistol shaped body parts which are detachably joined together by one or more fasteners. To improve cutting ability of the hand driven cutting device of the present invention, the flow passages on the upper surface of the lifting and supporting element are inclined, the leading edge of the flow passage being flush at the distal front upper surface of said lifting and supporting element, the flow passage extending rearward with an upward inclination to peak upon adjacent sides of the knife blade such that when the hand driven cutting device is driven forward, wherein material to be cut is introduced upon the leading edge of the lifting and supporting element, the flow passage guides the material to be cut into an actuated pincer and shearing action between the crest of the flow passage, the peripheral underside of the substantially pistol shaped body assembly and the cutting edge of the knife blade. The substantially pistol shaped body is provided with smoothly curved peripheral surface that provides graspable comfort for the operator, a graspable handle being the rearmost outer body periphery, extending outward and downwardly inclined from the irregular altitudinal apex of the substantially pistol shaped body assembly and rear-wardly away from the body distal point, the distal point being the front of the cutting device and direction of travel.

The two part body has symmetrical features to enable practical use by both left and right handed operator; the two part body is detachable/attachable to allow for interchanging the knife blade. The wheels are positioned to the outer lower periphery of the blade housing on opposing sides and in line with the cutting edge of the knife blade, whereby during the cutting process, in addition to enabling the cutter to travel, the wheels substantially clamp in position the material to be cut during the moment the material meets with the knife blade.

The wheels have a soft synthetic material on their outer perimeter to allow frictional gripping to take place upon the upper surface of the material to be cut. The knife blade to be clamped in the body is a replaceable type such as those commonly found in low cost craft knives.

To the accomplishment of the foregoing and related ends, certain illustrative aspects of the disclosed invention are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE FIGURES

The foregoing features, objects and advantages of the invention will become apparent to those skilled in the art from the following detailed description of a preferred embodiment, especially when considered in conjunction with accompanying drawings in which like numerals in the several views refer to corresponding parts.

DETAILED DESCRIPTION OF THE PREFERRED EMBODIMENT

Figure 1:
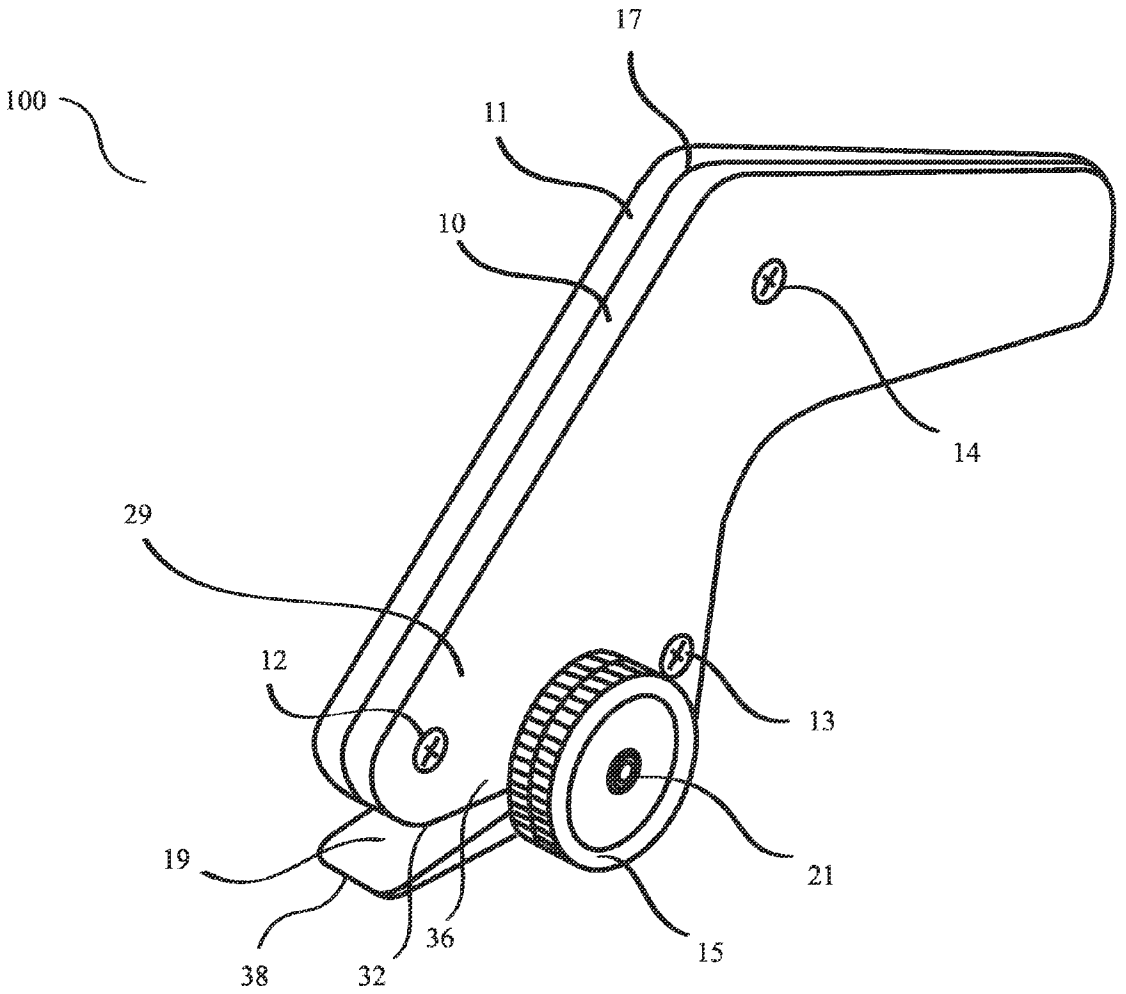
FIG. 1 is a perspective view of a hand driven cutting device in accordance with a preferred embodiment of the present invention.
Figure 2:
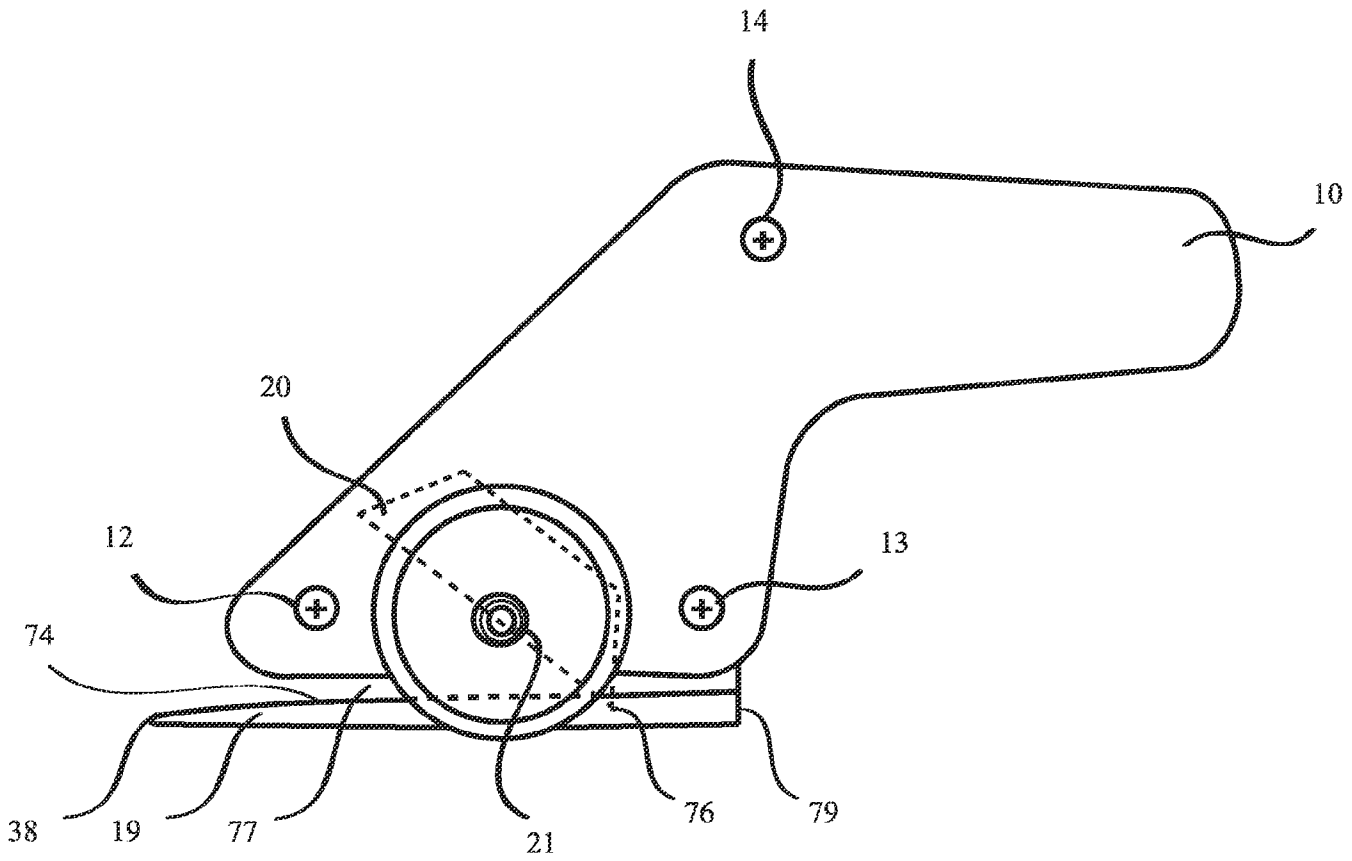
FIG. 2 is a right-side elevation view of a hand driven cutting device in accordance with a preferred embodiment of the present invention.
Figure 3:
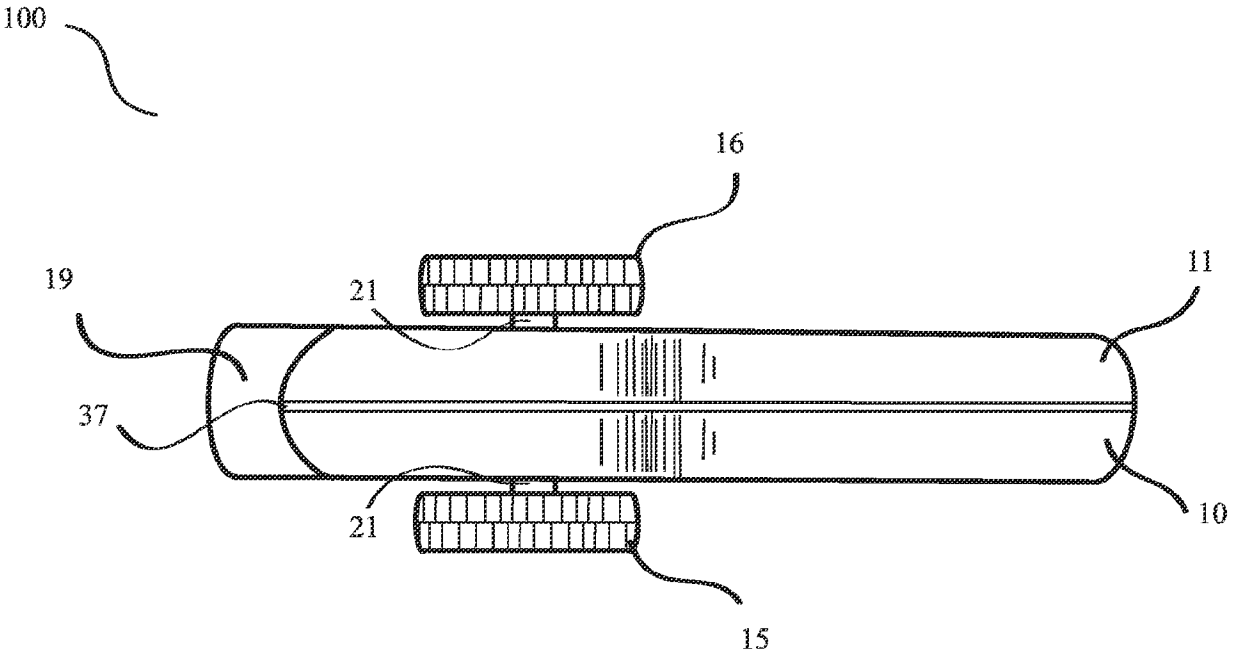
FIG. 3 is a top-plan view of a hand driven cutting device in accordance with a preferred embodiment of the present invention.

Turning now descriptive to the drawings, in which similar reference characters denote similar elements throughout the several views, FIG. 1 and FIG. 2 show a cutting device (100) of the present invention according to one preferred embodiment. The cutting device (100) has an elongate body housing (17). In a preferred embodiment, the elongate body (17), also referred to as body (17), comprises of two opposing sides (10) and (11) which are dividable rigid structures. The first body part (10) and the second body part (11) are symmetrical relative to a plane between them and are mirror images of each other so that, when coupled with each other, the resultant assembly forms the body (17) of the cutting device having a front substantially triangular portion (29) and a rear substantially rectangular portion (30). The rear substantially rectangular portion (30) forms an ambidextrous graspable handle. The opposing sides (10, 11) can be made up of any material such as durable plastic, aluminium or steel.

Figure 6:
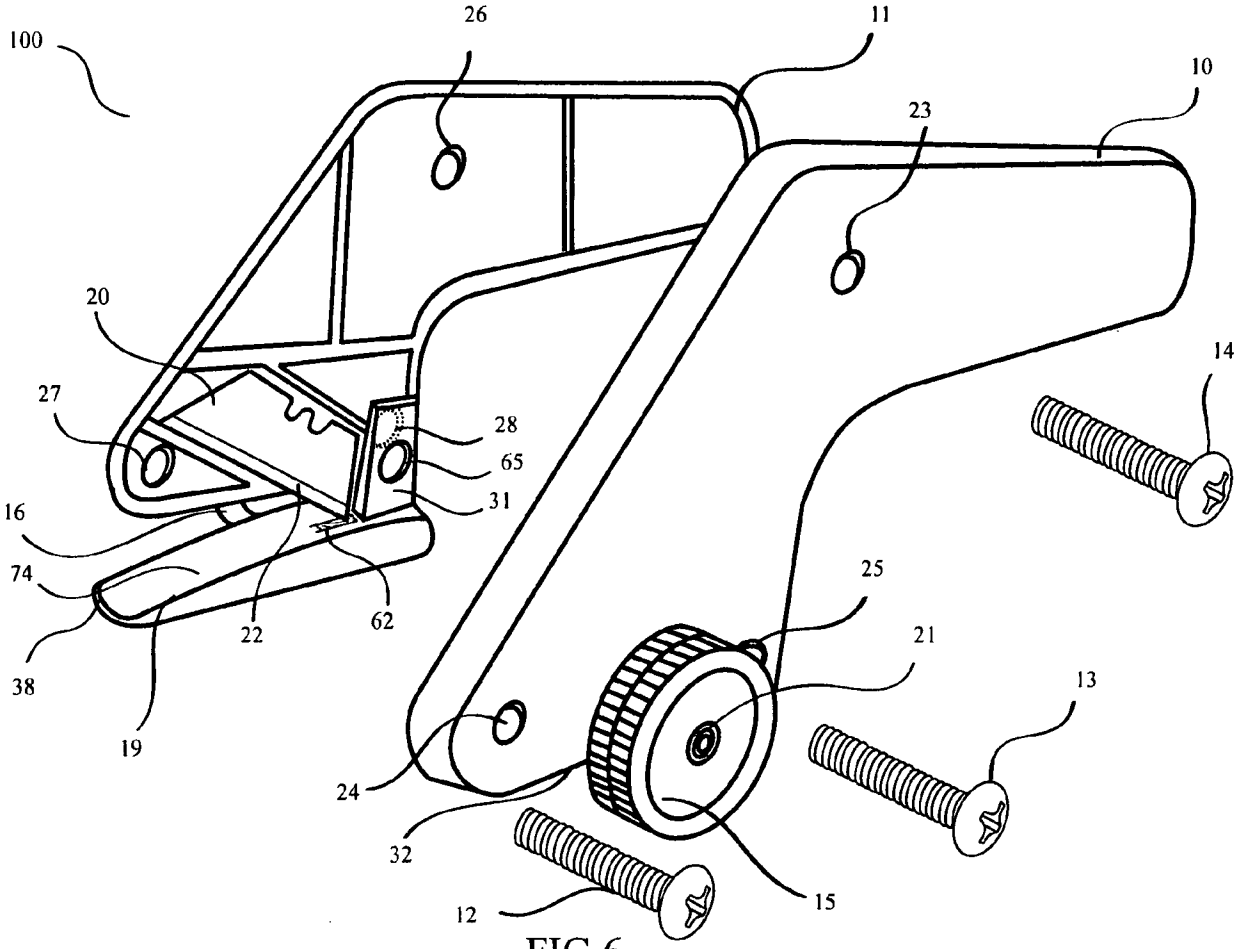
FIG. 6 is a pre-assembly view of a hand driven cutting device in accordance with a preferred embodiment of the present invention.

In a preferred embodiment, the two opposing sides (10, 11) are detachably attached together by suitable one or more fasteners such as screws (12), (13) and (14) as shown in FIG. 1, FIG. 2 and FIG. 6.

FIG. 2, FIG. 6, FIG. 7, FIG. 8, FIG. 9 and FIG. 10 show a knife blade (20) with its cutting edge (22) facing the direction of travel of the hand driven cutting device (100). In a preferred embodiment, the knife blade (20) is clamped between the opposing sides (10, 11) in the front substantially triangular portion (29) wherein the cutting edge (22) of the knife blade (20) protrudes from the underside (32) of the front substantially triangular portion (29) of the opposing sides (10, 11) when they become assembled via fasteners. The knife blade (20) is positioned so that the cutting edge (22) faces the front distal point of the front substantially triangular portion (29) of the body (17) in the direction of travel of the hand driven cutting device (100).

Reference to FIG. 1 through FIG. 10, a pair of wheels (15) and (16) is rotatably attached to/mounted on the either side of the front substantially triangular portion (29) via an axle (21). In some embodiments, the two wheels (15) and (16) can be mounted on two separate axles positioned on either side of the body (17). The axle (21) is preferably positioned in such a way that the cutting edge (22) of the knife blade (20) is centered between and in line with the axle (21) of the wheels (15) and (16). The pair of wheels (15, 16) enables the hand driven cutting device (100) to become turned on a vertical axis thereby facilitating cutting of a lamina material within an acute radius.

Reference to FIG. 1 through FIG. 10, the hand driven cutting device (100) further comprises a lifting and supporting element (19), also referred to as a wedge member (19), which is a plastic or metallic wedge positioned beneath the rear of the front substantially triangular portion (29) of the substantially pistol shaped body assembly (17). The wedge member comprises a top side (74), a bottom side (33), a first end (38), a second end (79) and a vertical fin (31) which is also referred to as a supporting element (31). In a preferred embodiment, the second end (79) is thicker than the first end (38) and the top side (74) rises gradually towards the second end (79) from the first end (38). The vertical fin (31) is positioned in-between the opposing sides (10, 11) of the body (17) in said substantially triangular portion (29) at the top side of the rear second end (79). The first end (38) of the wedge member (19) is located facing away from the pair of wheels (15, 16) and protruding beyond the forward distal periphery (37) of the front substantially triangular portion (29) and is configured to pick up a material work piece to be cut. The top side (74) of the wedge member (19) is upwardly disposed towards the rear of the substantially triangular portion (29) of the body assembly (17) so that, when a work piece passes over the upper surface of the wedge member (19), the work piece gets stretched in relation with the downward clamping pressure exerted by the pair of wheels (15, 16). The supporting vertical fin (31) has a central recess (65) to receive one of the fasteners and is clamped in place between the opposing sides (10, 11) in such a way that a space is defined between the top side (74) of the wedge member (19) and a lower surface (32) of the substantially triangular portion (29) when they are joined together by one or more fasteners (12, 13 and 14).

The wedge member (19) defines a flow passage for the material to be cut during the cutting action so that the cut materials, after being cut by the knife blade (20), pass through either side of the knife blade (20). In a preferred embodiment, the bottom side (33) of the wedge member (19) remains substantially flush with bottom (34) of the pair of wheels (15) and (16) as shown in FIG. 2 and in FIG. 4. In a preferred embodiment, the wedge member (19) is provided with a slot (62) on the top side (74). The wedge member (19) is configured to receive the knife blade (20) in the slot (62) in such a way that the bottom tip (76) of the cutting edge (22) of the knife blade (20) lies below the surface of the top side (74). Since the cutting edge (22) stops short of the lower surface of the bottom side (33) of the wedge member (19) preventing the knife blade (20) from causing any undercut scoring or damage upon a work surface.

The outer side of the front substantially triangular portion (29) in combination with the wedge member (19) forms a protective periphery around the cutting blade (20) which precludes physical contact of a person with the knife blade (20) during the use of the hand driven cutting device (100) of the present invention.

Figure 4:
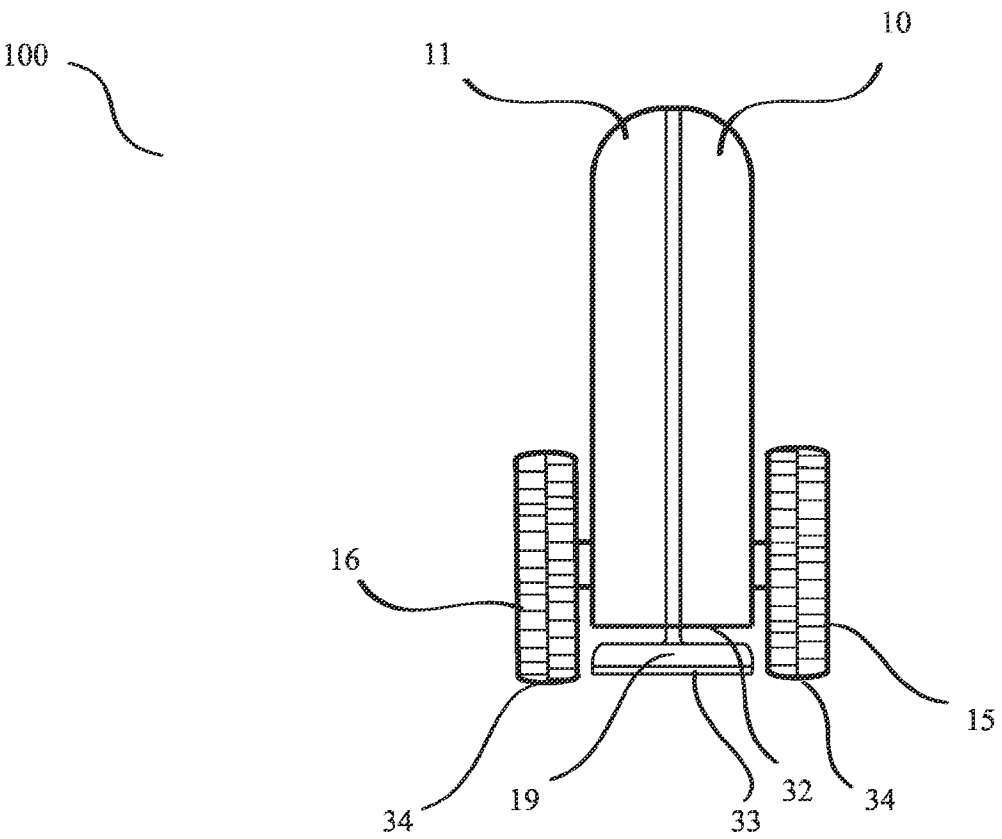
FIG. 4 is a front elevation view of a hand driven cutting device in accordance with a preferred embodiment of the present invention.
Figure 5:
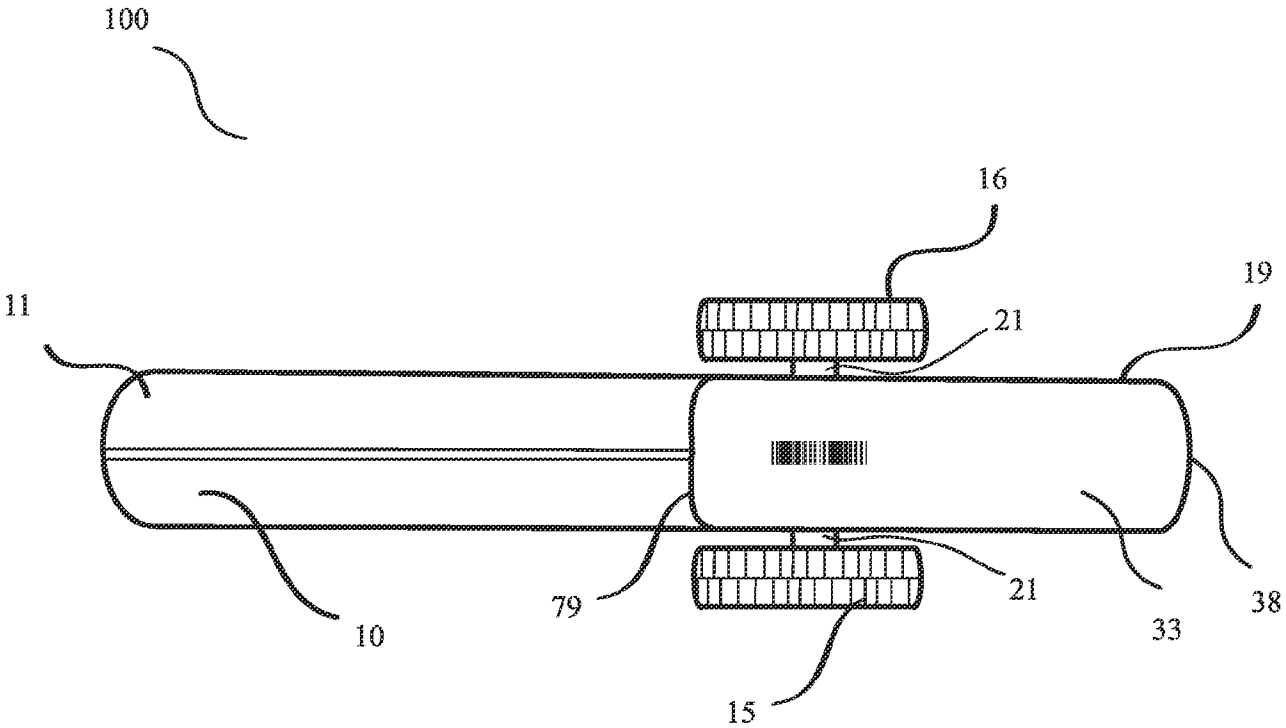
FIG. 5 is a bottom plan view of a hand driven cutting device in accordance with a preferred embodiment of the present invention.

FIG. 4 shows a front side view of the hand driven cutting device (100). The wedge member (19) is affixed in position in such a manner that there remains a small gap or space between the underside (32) of the front substantially triangular portion (29) of the opposing sides (10, 11) and the top side (74) of the flow passage of the wedge member (19). This gap provides the flow passage for the material to be cut and when the hand driven cutting device (100) is driven forward, the flow passage guides the material to be cut into an actuated pincer and shearing action between the crest of the flow passage, the peripheral underside (32) of the body and the cutting edge (22) of the knife blade (20).

FIG. 6 shows the pre-assembly view of the hand driven cutting device (100). The opposing sides (10) and (11) are shown separately. An interior cavity is defined by the opposing sides (10, 11) when combined and this cavity extends through the bottom surface (32) of the substantially triangular portion (29). The blade (20) with a forward cutting edge (22) and a rear dull edge is received in said cavity wherein a portion of said cutting edge (22) extends outward from the bottom edge (32) of the substantially triangular portion (29) of the body (17) and into the said space so that this portion of the cutting edge remains exposed. FIG. 6 shows how the opposing sides (10) and (11) are coupled together. The first of the opposing sides (10) has holes (23), (24) and (25) to receive jointing screws (12), (13) and (14). Similarly, the second of the opposing sides (11) has corresponding holes (26), (27) and (28). The holes are made at similar locations in both parts of the opposing sides (10) and (11). The vertical fin (31) of the wedge member (19) also has a hole/recess (65) through which jointing screw (13) is passed in order to hold it firmly in position. When the two opposing sides (10) and (11) are coupled, the knife blade (20) and the vertical fin (31) of the wedge member (19) are clamped between the first and second opposing sides (10) and (11). At the time of coupling, the screw (12) is tightened in the holes (24) and (27), screw (13) is tightened in the holes (25) and (28) and the screw (14) is tightened in the holes (23) and (26). When screws (12, 13) and (14) are tightened, the knife blade (20) is firmly clamped in a protruding position to the underside (32) of the opposing sides (10) and (11).

Operation of the Device

Reference to FIG. 1 through FIG. 10, the cutting device (100) is required to be driven forward over a work material such as a lamina material (72) by holding the rear substantially rectangular portion (30) by a user. The rear substantially rectangular portion (30) of the cutting device (100) forms an ambidextrous graspable handle which enables a user to hold and use the device with either of his/her hands. This facilitates making complex cuts by the device (100) on a material at any desired angle.

Figure 7:
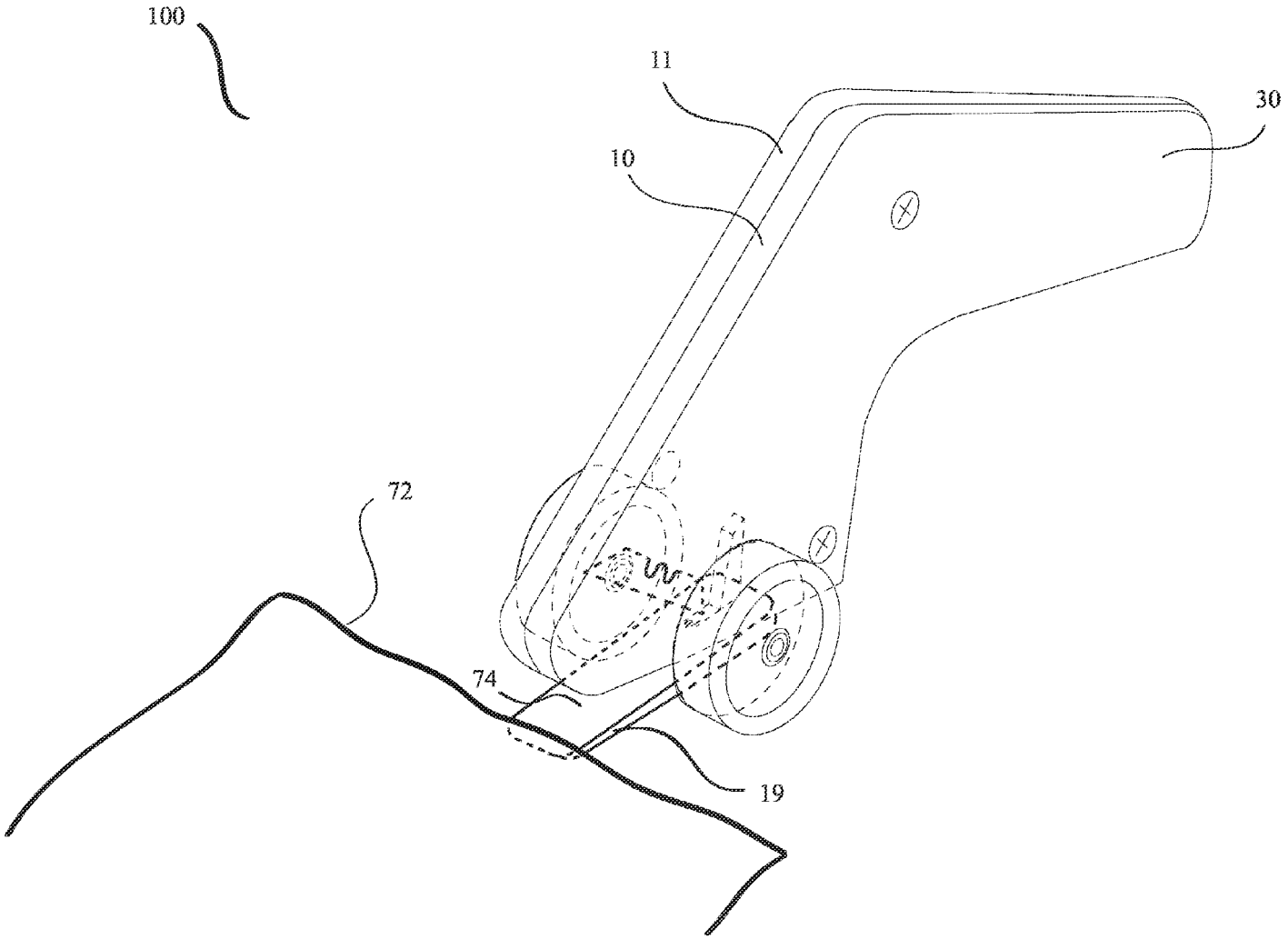
FIG. 7 is a perspective view of the cutting device of the present invention just as the wedge member picks up a material to be cut.
Figure 8:
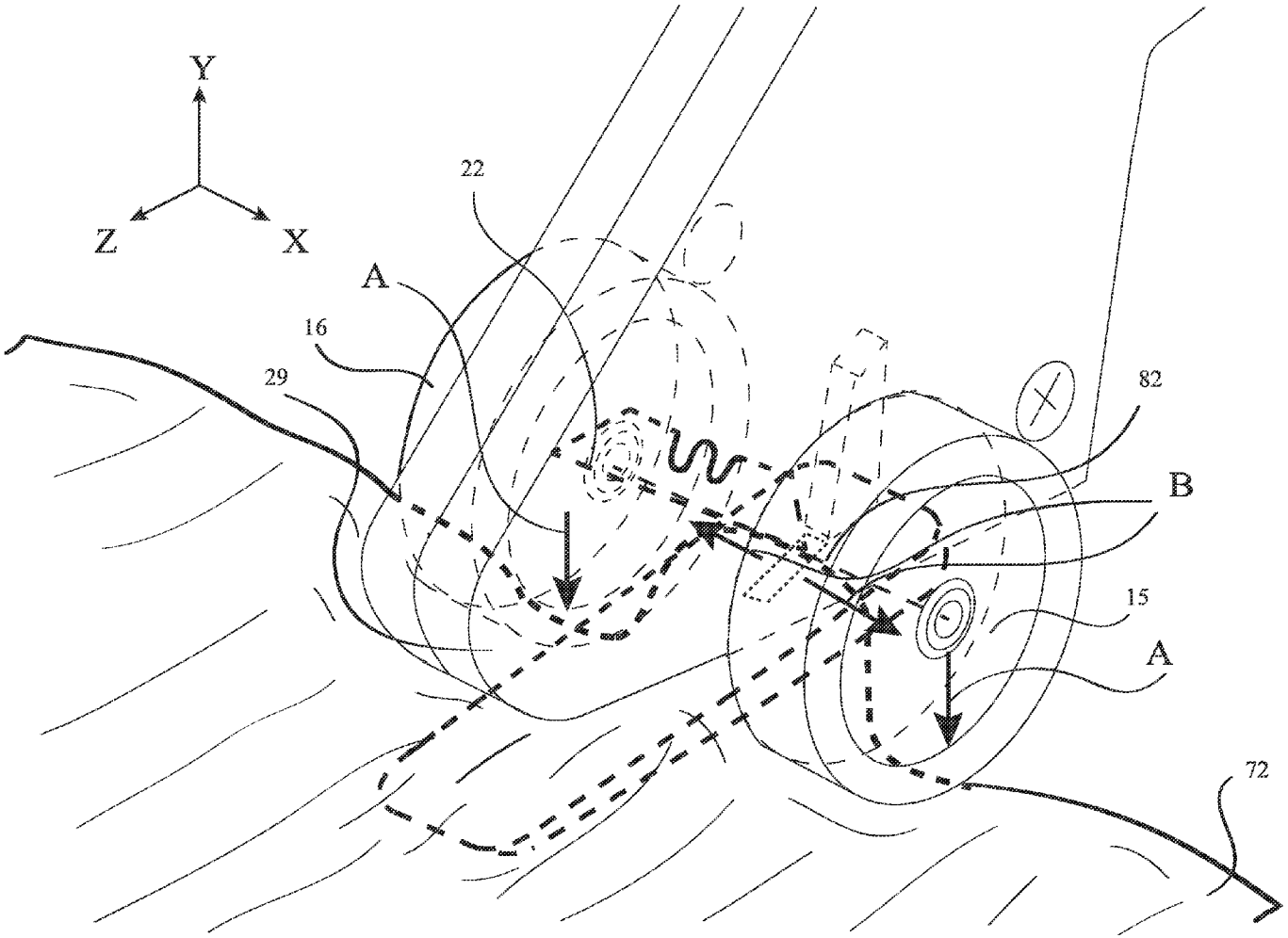
FIG. 8 is a perspective view of the forward facing substantially triangular portion of the cutting device with a material to be cut approaching the cutting blade.

Reference to FIG. 7, when the rear substantially rectangular portion (30) is grasped by a user and the cutting device (100) is manually driven forward upon a work surface, an inclined downward force acts on the first end (38) of the wedge member (19) and this force tries to keep the first end (38) grounded which helps in picking up the material (72) to be cut. As shown in FIG. 7, the first end (38) of the wedge member (19) slips below the edge of the material (72) when the cutting device (100) is moved forward towards the material (72).

When the cutting device (100) is further moved forward, the edge of the material (72) picked up by the wedge member (19) climbs up the wedge member (19) over its top side (74) towards the second end (79) and reaches the space (77) provided between the top side (74) of the wedge member (19) and the bottom surface (32) of the substantially triangular portion (29). The material (72), at one point of time, during the movement of the cutting device (100), comes closer to the cutting edge (22) of the cutting blade (20). The cutting blade (20) is received in an interior cavity defined by the opposing sides (10, 11) of the body and extends through the bottom surface (32) of the substantially triangular portion (29) and into the space (77) so that a portion of the cutting edge (22) of the cutting blade (20) remains exposed. At the same time, reference to FIG. 8, the portion of the material (72) lying on either side of the wedge member (19) comes beneath the wheels (15) and (16) of the cutting device (100). The two wheels (15) and (16), which are encased with a gripping material, exerts a downward force (A) on the material (72) along the Y axis (Y axis is hereinafter alternately and interchangeably referred to as first axis) which passes perpendicularly through the axles of the wheels (15 and (16). The gripping material of the wheels (15) and (16) ensures that the material (72) does not slip whilst beneath the wheels.

Figure 9:
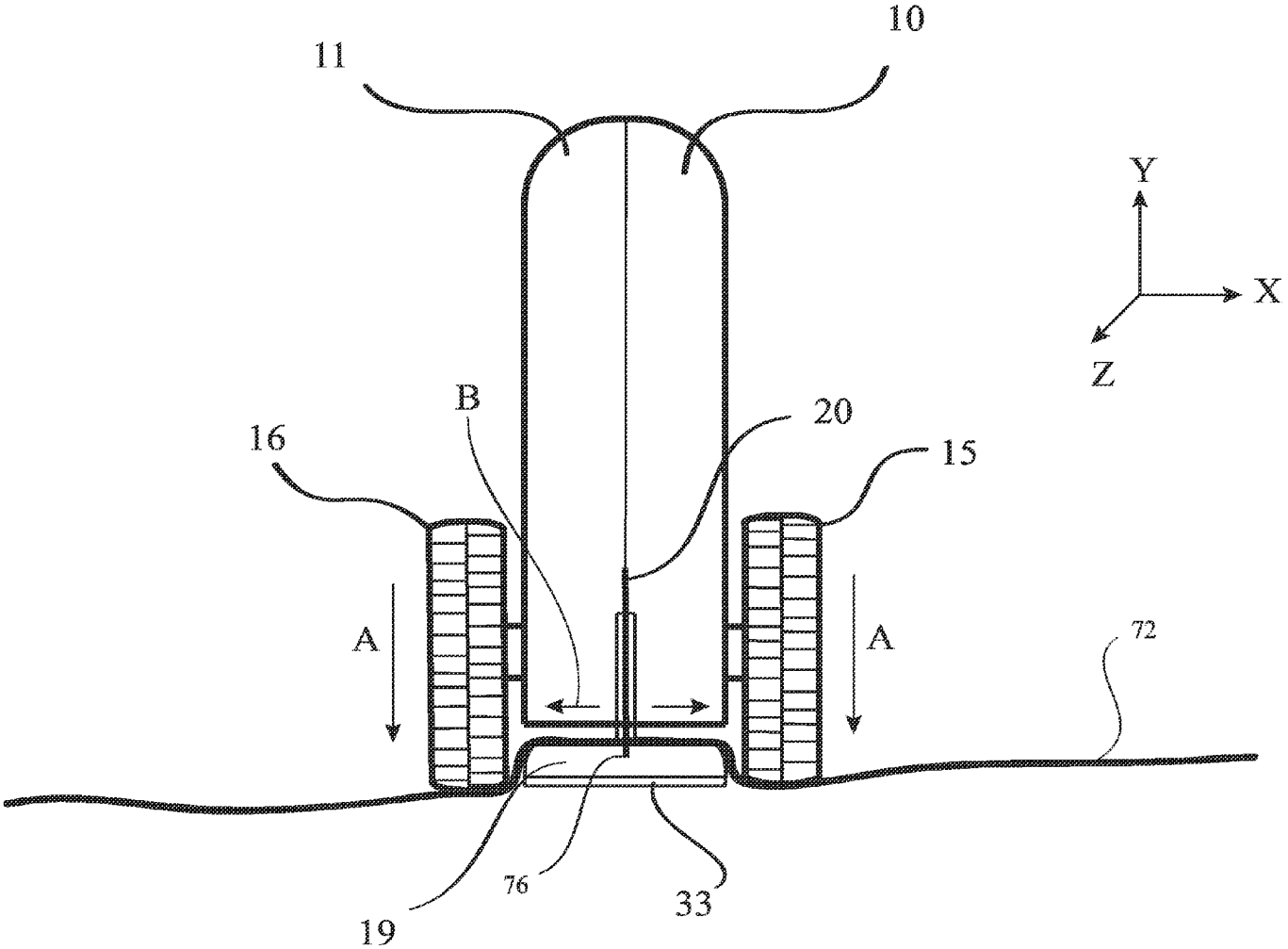
FIG. 9 illustrates a front elevation view of the cutting device of the present invention with the material to be cut resting upon the top side of the wedge member while the material is pressed down by the wheels of the cutting device on both sides of the wedge member.
Figure 10:
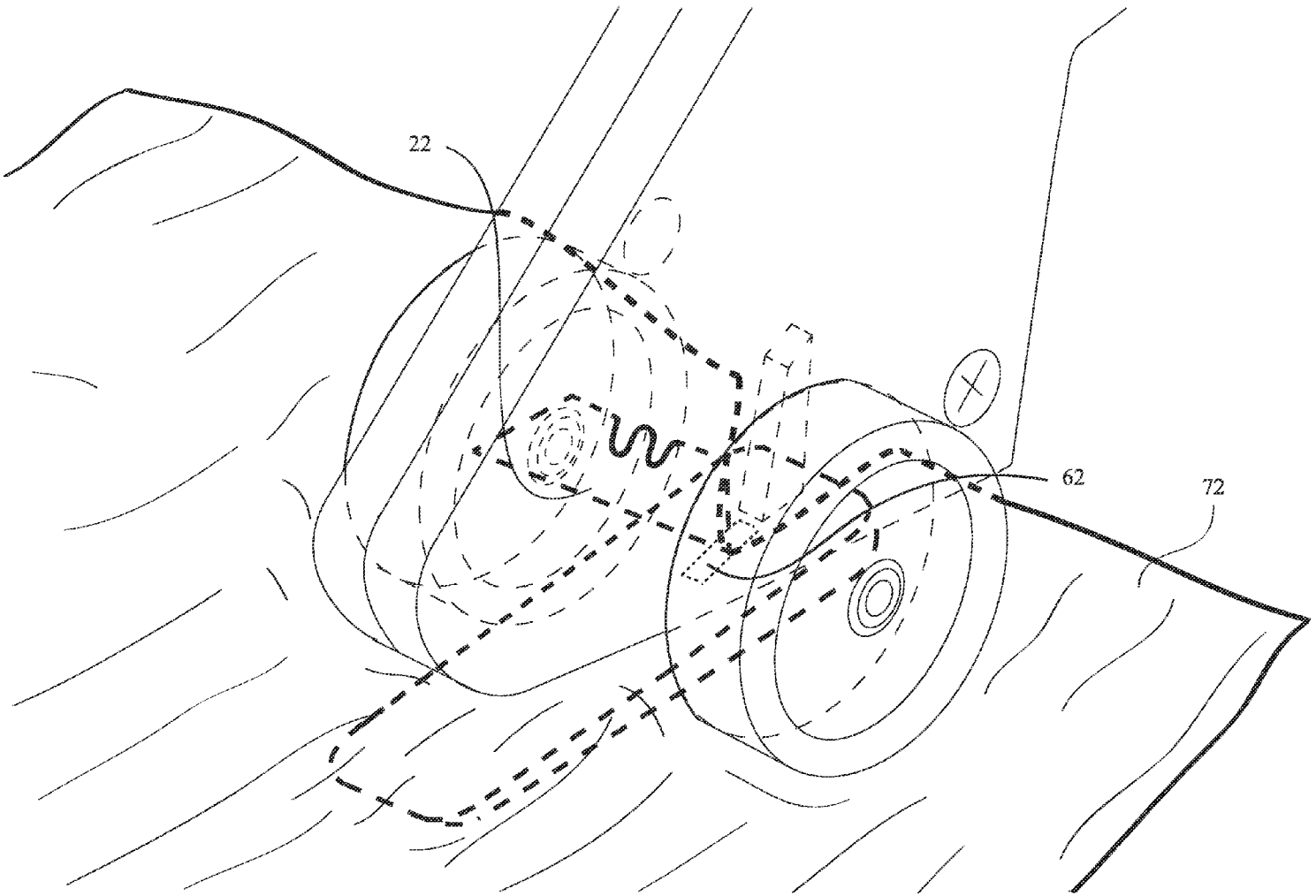
FIG. 10 is a perspective view of the forward facing substantially triangular portion of ° the cutting device with a material being cut by the cutting blade.

Reference to FIG. 9 and FIG. 10, since, the bottom surface of the wheels (15) and (16) remains substantially flush with the bottom side (33) of the wedge member (19), the material (72) under the wheels (15) and (16) also remains on a horizontal plane situated below the top side (74) of the wedge member (19). That implies, as the material (72) climbs up the top side (74), which is gradually upwardly inclined towards the thicker second end (79), and, at the same time, comes under the wheels (15) and (16), the downward force (A) produces a tensile stress (B) on the material (72) along the X axis (X, Y and Z are three mutually orthogonal directions, where Y is defined as the direction normal to the material) perpendicular to the longitudinal axis of the wedge member (19). The X axis (X axis is hereinafter alternately and interchangeably referred to as second axis), along which the tensile stress (B) acts, either coincides the axis (82) or is parallel to the axis (82) on the X-Y plane, wherein axis (82) is the axis that connects the axles on which wheels (15) and (16) are mounted. So, in a preferred embodiment, the cutting blade (20) is secured in the cavity in such a way that the cutting edge (22) intersects the X axis on the X-Y plane (X-Y plane is first axis-second axis plane) and meets the material (72) over the top side (74) of the wedge member (19). This tensile stress (B) ensures that, when the material (72) nears the cutting edge (22) in the space (77), the material (72) remains stretched along the X axis. Thus, as the cutting device (100) moves forward in the Z axis, the material (72) gets cut by the cutting edge (22) of the cutting blade (20) easily and smoothly.

Since the cutting device (100) moves on a single pair of wheels (15) and (16), the cutting device (100) can move at any angle on the work surface. The ambidextrous graspable handle provided by the rear substantially rectangular portion (30) of the cutting device (100) enables a user to use just a single hand to drive and manoeuvre the cutting device (100) to make cuts on the material at a straight line or at any desired angle.

Since, the bottom tip (76) of the cutting blade (20) lies below the surface of the top side (74) in the slot (62), it ensures that the material (72) to be cut always comes in full contact with the cutting edge (22). If the bottom tip (76) remains on or above the surface of the top side (74), the cutting blade (20) may not be able to impart a proper cut on the material (72) or it may cause incomplete cut or scoring on the material.

The cutting blade (20) is angled upward from the top side (74) so that the cutting blade (20) resists the lamina material (72) being cut from moving upward which is likely to happen when the cut occurs.

The cutting edge (22) of the cutting blade (20) remains exposed only in the space (77) and this space (77) is so small that the cutting edge (22) or any portion of the cutting blade (20) cannot be touched by fingers of a user even if attempted.

The knife blade (20) is any suitable knife blade known in the art. To replace the knife blade (20) when it becomes blunt, the first and second opposing sides (10) and (11) are detached by removing the fasteners (12), (13) and (14). Examples of the work piece material i.e. the lamina material cut into different regular and irregular shapes by the hand driven cutting device (100) of the present invention includes, but is not limited to, PVC and foils, vinyl membranes, technical textiles, papers, cards and the like.

It is noted that the embodiment of the hand driven cutting device with a pair of wheels described herein in detail for exemplary purpose is of course subject to many different variations in structure, design, application and methodology. Because many varying and different embodiments may be made within the scope of inventive concepts herein taught, and because many modifications may be made in the embodiment herein detailed in accordance with the descriptive requirements of the law, it is to be understood that the details herein are to be interpreted as illustrative and not in a limiting sense.

What is claimed is:

1. A cutting device, said cutting device comprising:

a body, said body comprising two opposing sides, said opposing sides being mirror images and each having a front end fastener hole, a rearward fastener hole, and a supporting fastener hole, said two opposing sides being connected together by a front end fastener disposed in said front end fastener holes, a rearward fastener disposed in said rearward fastener holes, and a supporting fastener disposed in said supporting fastener holes to form said body, said body having a forward facing substantially triangular portion and a rearward facing substantially rectangular portion, said front end fastener and said supporting fastener are located in said substantially triangular portion, said rearward fastener located in said substantially rectangular portion;

a wedge member, said wedge member comprising a top side having a slot, a bottom side, a first end, a second end thicker than said first end, and a supporting element, said supporting element projecting upwards from said top side of said second end of said wedge member, said supporting element positioned in-between said opposing sides of said body in said substantially triangular portion, said supporting element has a central recess to receive said supporting fastener, said top side of said wedge extending along a bottom surface of said substantially triangular portion of said body to define a space there between, said first end configured to pick up a material work piece to be cut over said top side when said cutting device is driven forward;

two wheels, said two wheels rotatably mounted on one or more axles positioned respectively on each side of said substantially triangular portion of said body, wherein said two wheels exert a downward force along a first axis on said material coming beneath said two wheels on either side of said wedge member and said downward force produces a tensile stress along a second axis perpendicular to said first axis on said material picked up by said wedge member;

an interior cavity defined by said opposing sides of said body and extending through said bottom surface of said substantially triangular portion;

a blade with a forward cutting edge and a rear dull edge, said blade being received in said cavity wherein a portion of said cutting edge extends outward from said bottom surface of said substantially triangular portion of said body and into said space so that said portion of said cutting edge is exposed and said cutting edge intersects a plane of said first axis-second axis;

wherein said material gets cut when said material comes in contact with said cutting edge over said wedge member as said cutting device is driven forward.

2. The cutting device of claim 1, wherein a bottom tip of said cutting edge lies below a surface of said top side of said wedge member inside said slot.

3. The cutting device of claim 1, wherein said first axis lies perpendicular to an axis passing through said one or more axles.

4. The cutting device of claim 3, wherein said second axis lies parallel to said axis passing through said one or more axles on said first axis-second axis plane.

5. The cutting device of claim 1, wherein said substantially rectangular portion enables a user to use either of his hands to drive said cutting device to impart said cut on said material.

6. The cutting device of claim 1, said two wheels and said substantially rectangular portion enable maneuvering of said cutting device at any desired angle while being driven forward and said two wheels always exert said downward force on said material to be cut and said tensile stress induced by said downward force on said material facilitates said cut.

* * * * *